United States Patent [19]

Harrell, Jr.

[11] Patent Number: 4,962,558

[45] Date of Patent: Oct. 16, 1990

[54] DEVICE FOR CLEANING SURFACES SUBMERGED IN A FLUID

[76] Inventor: William S. Harrell, Jr., 41 W. Meadowlark La., Lawrenceville, Ga. 30245

[21] Appl. No.: 366,435

[22] Filed: Jun. 15, 1989

[51] Int. Cl.[5] ..... E04H 3/20

[52] U.S. Cl. ..... 15/1.7; 15/160; 15/246; 15/257 R

[58] Field of Search ..... 15/1.7, 160, 246, 257 R

[56] References Cited

U.S. PATENT DOCUMENTS

| | | | |
|---|---|---|---|
| 2,243,576 | 5/1941 | Otto | 15/1.7 |
| 4,637,087 | 1/1987 | Feinberg | 15/1.7 |
| 4,783,868 | 11/1988 | O'Callaghan | 15/1.7 |

FOREIGN PATENT DOCUMENTS

| | | | |
|---|---|---|---|
| 584029 | 1/1987 | United Kingdom | 15/1.7 |

*Primary Examiner*—Edward L. Roberts

*Attorney, Agent, or Firm*—Needle & Rosenberg

[57] ABSTRACT

A device for cleaning surfaces submerged in a fluid, such as pools and boat, comprising a handle, a brush attachable to the handle for cleaning an underwater surface and a wing member hingedly attached to the device adjacent the brush. The wing member is pivotable into an upwardly inclined position when the brush is moved in a downward direction along the and into a downwardly inclined position when the brush is moved in an upward direction along the surface, the wing member has jetting means for jetting fluid against the surface to be cleaned during the upward movement.

50 Claims, 2 Drawing Sheets

DEVICE FOR CLEANING SURFACES SUBMERGED IN A FLUID

THE BACKGROUND OF THE INVENTION

The present invention relates to cleaning devices, and more particularly to an attachment to such devices which increases the efficiency of the brushes or other tools used in cleaning surfaces under fluid, such as swimming pool walls and floors and boat surfaces.

A major concern in the maintenance of tanks for holding liquids is the accumulation of deposits on the inner tank surfaces. For example, algae and other deposits will accumulate on swimming pool walls and floors, and must periodically be removed.

The typical device for cleaning such tanks or pools is comprised of a long pole having a handle at a first end and a brush at an opposite end. The user stands at the edge of the tank, above the liquid, and maneuvers the bristles of the brush in an upward and downward direction against the tank's inner walls and in a back and forth direction across its floor. A problem exists, however, in that the user must exert considerable strength to hold the brush against the wall or floor while at the same time moving the brush about.

U.S. Pat. No. 2,243,576 to Otto discloses a handle-type brush having a tiltable vane positioned in opposed relation to the brush bristles. The vane of Otto pivots upwardly when the brush is pushed downward through the fluid towards the tank floor and pivots downwardly when the brush is pulled upwards. The pressure exerted on the vane forces the brush against the wall during movement in each direction. However, while the Otto device enables the brush to be held against the wall, it does not remove all of the deposits.

Another concern in the maintenance of tanks, and particularly swimming pools, is the need to kill algae and other organisms present in the water. While some of these organisms float freely in the tank, a large number adhere to the tank inner surfaces. To kill these organisms, chemicals, such as chlorine, are added to the pool. The concentration of chemicals needed to kill the large accumulations of organisms along the inner surface is greater than that needed to kill those floating within the water. However, to date, the method of killing the organisms has been to provide an excessively large amount of chemicals to the water. In this way, the concentration of chemicals throughout the entire volume of water becomes so high that all the organisms, including those accumulating on the inner surfaces of the tank, are killed. This method results in a waste of chemicals, since the high concentration is only needed along the inner surfaces, while substantially lower concentration would suffice in the remainder of the water.

Therefore, there exists a need for a device which will increase the efficiency of brushes and other tools used in cleaning surfaces under fluid. There also exists a need for such a device which eliminates the need to use excessive amounts of chemicals in disinfecting a tank full of fluid, such as a swimming pool.

SUMMARY OF THE INVENTION

The present invention relates to a device for cleaning the interior surfaces of tanks, such as swimming pools, as well as boat surfaces. The device includes a pole, a tool attachable to the pole for cleaning the surface, and a wing member pivotally attached to the pole adjacent to the tool. The wing member is pivotable into an upwardly inclined position when the pole and tool are moved through the fluid in a downward direction along the tank wall, and into a downwardly inclined position when the brush and pole are moved in an upward direction along the tank wall. The wing member has jetting means for jetting fluid against the tank wall during the upward movement. The jetting means preferably comprise an aperture in the wing member surrounded by a nozzle and a rim portion extending from the wing member and adjacent to the aperture for gathering and directing water to the aperture. Reinforcing ridges are also provided for giving dimensional stability to the wing member, as well as for aiding the direction of water towards the aperture. A plurality of apertures may also be utilized, with a number of adjacent reinforcing ridges.

Attachment means are provided for pivotally attaching the wing member to the pole. In a first embodiment, a pair of attachment holes are provided on a clamping assembly through which the wing member may be removably attached. An upper attachment hole is located adjacent and below a first stopping flange having an approximately 45° angle relative to the transverse axis of the pole. A lower attachment hole is provided below the upper hole, and adjacent and above a second stopping flange which extends perpendicularly relative to the longitudinal axis of the pole. When the wing member is attached through the upper hole, it is pivotable upwardly and downwardly, preferably 45° relative to the transverse axis of the pole in each direction, until meeting one of the flanges. This configuration is preferred when the device is utilized against a vertical tank wall. When the wing member is attached through the lower hole, it will pivot a greater degree upwards until meeting the upper flange, and will be limited to a position perpendicular to the transverse axis of the pole by the lower flange. This configuration is preferred when the device is utilized for maintaining a vacuum or other tool on the floor of a tank.

In a second embodiment, a single attachment hole may be provided between a pair of flanges located on the attachment means, each flange having an angularly disposed surface facing the hole. In this configuration, the pivoting wing member will be limited by each flange.

In another embodiment of the present invention, the pole is preferably hollow or otherwise has a conduit running from its grip end to its brush end. Located at the grip end of the pole are means for delivering a chemical, such as a cleaning fluid, to the conduit. These means, for example, may be threading members capable of being threadingly attached to a container holding the cleaning fluid. Furthermore, means for expelling the cleaning fluid, such as an aperture, are provided at the brush end of the pole. In this manner, water being expelled from the jets of the wing member directs the cleaning fluid expelled from the expelling means towards and against the walls of the tank. This enables a high concentration of cleaning fluid to be controllably delivered to the tank surfaces.

Therefore, it is an object of the present invention to provide a device which increases the efficiency of brushes and other tools used in cleaning surfaces under fluid.

It is also an object of the present invention to provide a device which eliminates the need to use excessive amounts of chemicals for disinfecting or otherwise cleaning a tank full of fluid, such as a swimming pool.

These and other objects and advantages of the present invention will become more fully apparent when the detailed description of the preferred embodiments of the invention is read in conjunction with the accompanied drawings.

DETAILED DESCRIPTION OF THE PREFERRED EMBODIMENTS

Figure 1:
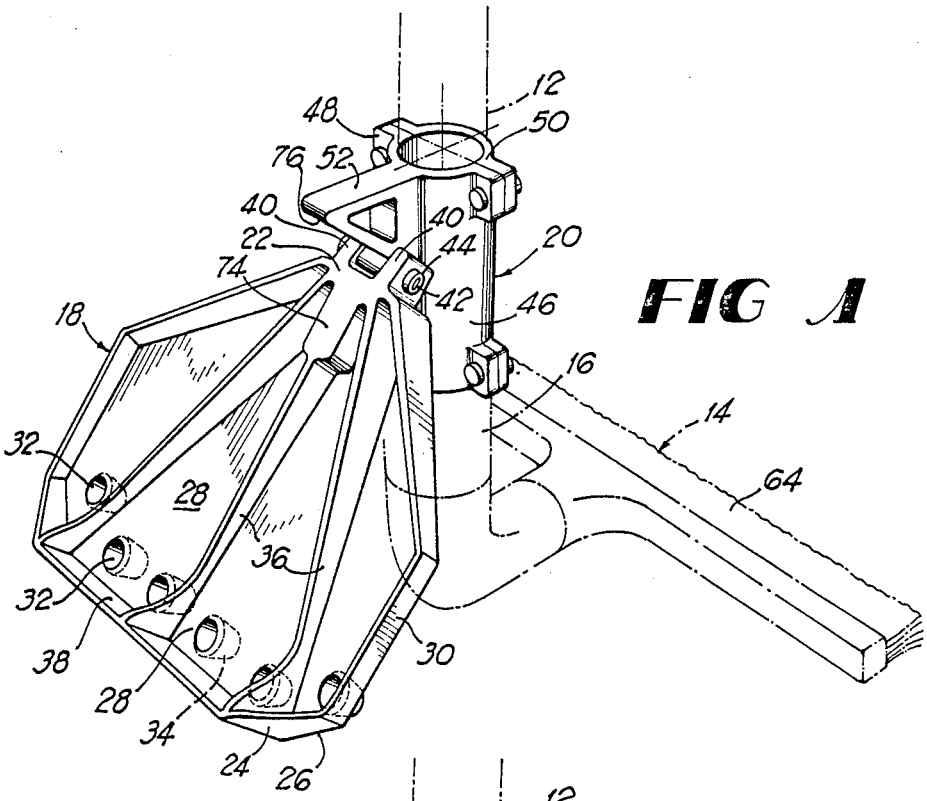
FIGS. 1 and 2 are partial perspective views of the device of the present invention having a pair of attachment holes.

FIG. 1 illustrates one embodiment of a device 10 of the present invention, including a pole 12, a bristled brush 14 attached to the lower or "brush" end 16 of the pole 12, and a wing member 18 pivotally attached to the pole 12 by attachment means 20 adjacent to but opposite the bristles 64 of the brush 14. The pole 12 may be of any length, and the term as used herein also includes relatively short handles.

The wing member 18 is preferably fan shaped, having a relatively narrow attachment side 22 and a relatively wide distal side 24. Furthermore, the wing member 18 is substantially flat and has an inner surface 26 and an outer surface 28 and is preferably made of a lightweight, yet rigid and non-corroding material such as plastic. The periphery of the outer surface 28 is defined by a rim portion 30 extending outwardly to the outer surface 28. The rim portion 30 is preferably widest at the distal side 24 of the wing member 18 and narrows toward the attachment side 22.

Jetting means are provided on the wing member 18 for delivering fluid towards the walls at high pressure. For example, the means may comprise a plurality of apertures 32 extending through the wing member 18 from the outer surface 28 to the inner surface 26 and located adjacent the length of the distal side 24. The aperture 32 is preferably tapered so as to be widest at the outer surface 28 and narrowest at the inner surface 26. Furthermore, nozzles 34 may be provided extending from the inner surface 26 of the wing member 18 and surrounding the apertures 32. A plurality of reinforcing ridges 36 may also be provided extending outwardly from the outer surface 28 between the distal and attachment sides 22,24 for giving dimensional stability to the wing member 18. The ridges 36 are preferably located adjacent the apertures 32 and are integral with the front rim portion 38, thereby forming, along with the front rim portion 38, means for directing fluids towards the aperture 32 when the wing member 18 is pivoted in a downward direction. The rim portion 30 also aids in forcing the wing member 18 towards the wall during the upward movement of the pole 12.

Any means for pivotally attaching the wing member 18 to the pole 12 may be used. For example, a yoke and post type of attachment assembly may be employed. A pair of support flanges 40 are provided at the attachment side 22 of the wing member 18. Each support flange 40 has an opening 42 through which a post may be simultaneously provided for pivotally securing the wing member 18 to the attachment means.

Figure 2:
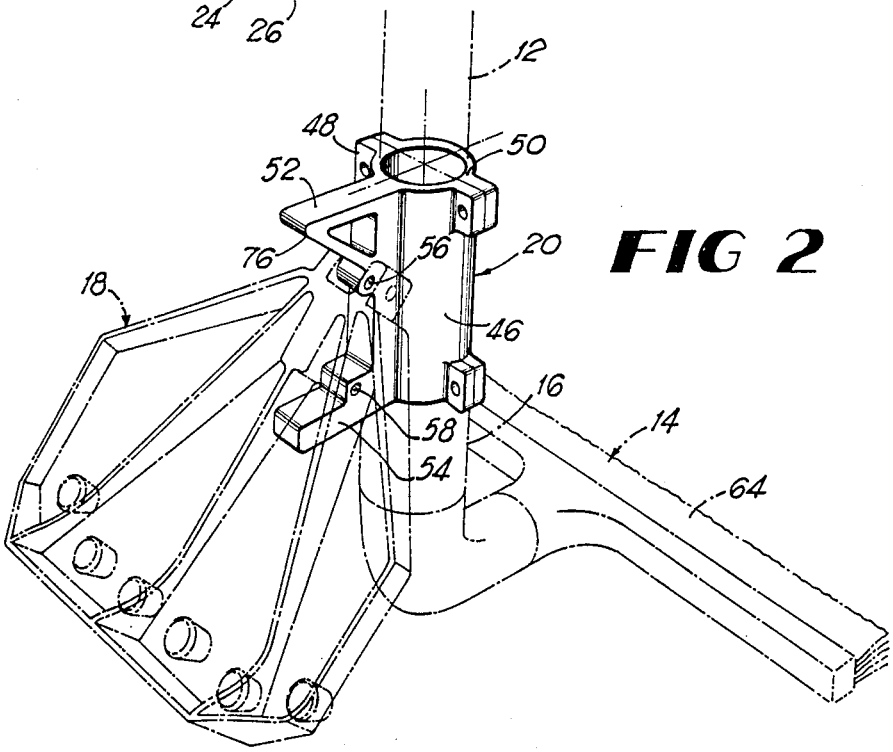

In a first embodiment of the invention, as set forth in FIGS. 1, 2, 3 and 4, the attachment means comprise a clamping assembly 46 having a first clamp member 48 attachable to a second clamp member 50 around the pole 12 by thumbscrews or other similar means. A pair of stopping flanges 52,54 are located on the first clamp member 48 for limiting the degree of pivot of the wing member 18. A first stopping flange 52 is provided at the upper portion of the first clamp member 48 and has a contacting surface 76 with an approximately 45° angle relative to the transverse axis of the pole 12. An upper attachment hole 56 is provided adjacent and below the first stopping flange 52 through which the post may be placed for pivotally securing the wing member 18 to the attachment means. As best seen in FIG. 2, a second stopping flange 54 is provided at the lower portion of the first clamp member 48. The second stopping flange 54 has a wing contacting surface 74 which is substantially parallel to the transverse axis of the pole 12, and a lower attachment hole 58 is provided adjacent and above the second stopping flange 54 for alternatively attaching the wing member 18 to the attachment means 20. In this manner, when the wing member 18 is attached to the upper attachment hole 56, it may pivot at 45° angles both upwardly and downwardly relative to the transverse axis of the pole 12. In the upward pivot, a contacting portion of the outer surface 28 of the wing member 18 will contact and be limited by the first stopping flange 52 and in the downward pivot the inner surface 26 of the wing member 18 will contact and be limited by the second stopping flange 54. This will cause the tool 66 to be held against the interior tank surface by hydrodynamic forces of the fluid pressing against the wing member 18.

Figure 4:
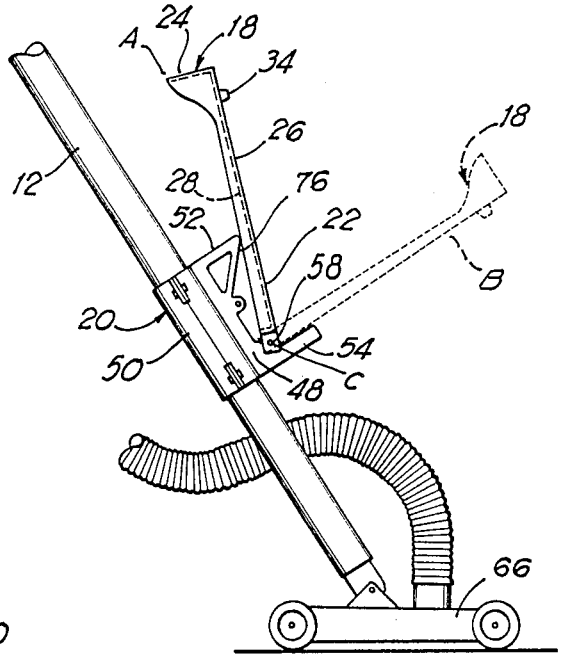
FIG. 4 is a side elevational view of the present invention illustrating the utilization of an alternative embodiment of a device of the present invention.

Alternatively, as seen in FIG. 4, when the wing member 18 is secured in the lower attachment 58, it will pivot upwardly at a greater than 45° angle relative to the transverse axis of the pole 12 and will pivot downwardly to an angle perpendicular to the longitudinal axis of the pole 12. This will maximize fluid pressure to the outer surface 28 and will enable the device 10 to be used for maintaining a vacuum or other tool on the floor of the tank.

Figure 5:
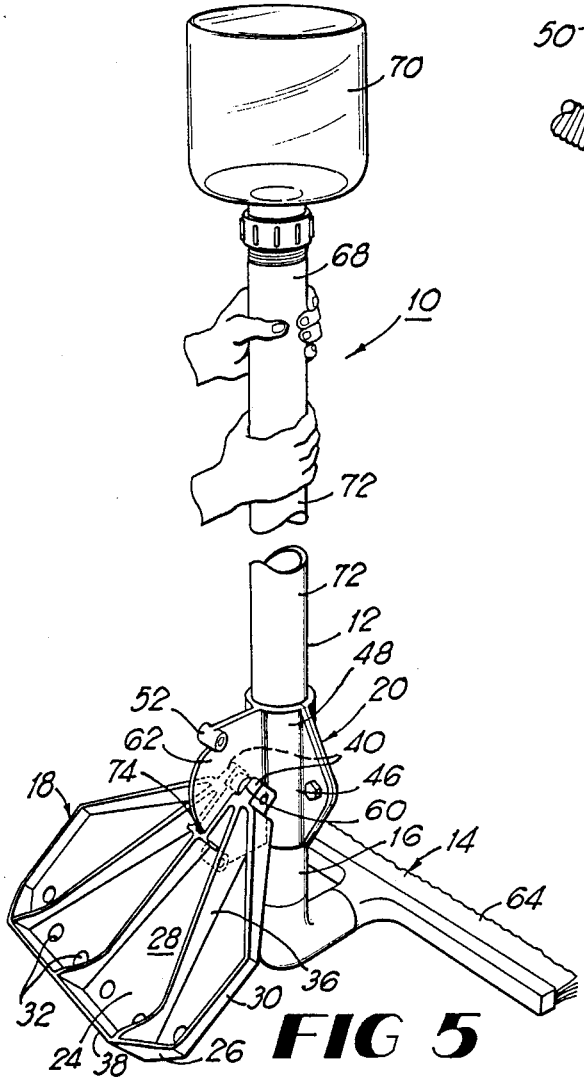
FIG. 5 is a perspective view of an alternative embodiment of the device of the present invention and also including a container for delivering fluids to the device.

Alternatively, as seen in FIG. 5, the first clamp member 48 may have a single attachment hole 60 at its midpoint for providing the sole means for pivotally attaching the wing member 18 to the attachment means 20. Preferably, the hole 60 is provided on a stabilizing member 62 extending from the first clamp member 48 which provides additional stability to the wing member 18. Furthermore, a first stopping flange 52 may be provided at the upper portion of the first clamp member 48 and a second stopping flange 54 may be provided at the lower portion of the first clamp member 48. Similar to the embodiment shown in FIG. 3, the stopping flanges 52,54 will limit the pivoting movement of the wing member 18 to a predetermined path. The degree of pivot of the wing member 18 in the second embodiment depends upon the positioning of the stopping flanges 52,54. An auxiliary hole may be provided on the stabilizing member capable of having a removable flange placed therethrough. This will allow the downward path of pivot to be limited to a position relative to the pole 12, i.e. 50° to 60° or perpendicular depending upon use, such as seen in FIG. 4, and is useful in maintaining a tool 66 along the floor of the tank.

Figure 3:
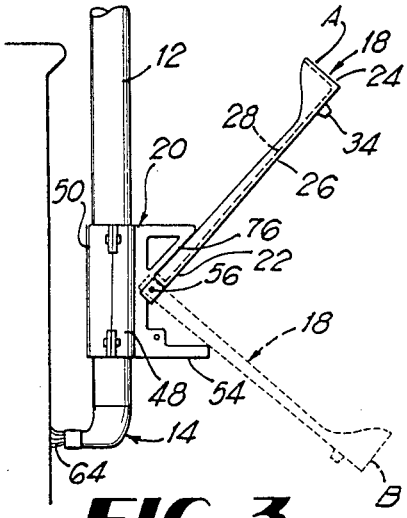
FIG. 3 is a side elevational view illustrating the utilization of one embodiment of the present invention.

With reference to the foregoing, it is to be observed, as shown in FIGS. 3 and 5, that the pole 12 and tool 66 are to be first inserted into the tank and moved downwardly away from the operator through the fluid. When so moved, the wing member 18 will pivot upwardly towards the operator. Continued movement of the pole 12 and brush 14 downwardly is resisted by the water bearing on the wing member 18 and the transverse component of this resisting force is directed towards the wall so that the brush 14 is automatically forced into engagement with the wall, depicted as position A in FIG. 3. At the end of the movement, when the pole 12 and brush 14 are elevated towards the operator, the wing member 18 assumes the dotted line position B seen in FIG. 3 as the resistance of the water applied to the wing member 18 again serves to force the brush bristles 64 into engagement with the wall. Excess fluid will pass over the narrower side of the rim portion 30 to enhance the movement of the device 10 through the fluid. When the wing member 18 is placed in the lower attachment 58, as seen in FIG. 4, movement of the pole 12 and tool 66 away from the operator will force the wing member 18 upwards, thereby forcing the tool to the floor of the tank. When the pole 12 and tool 66 are moved backwards towards the operator, the wing member 18 will pivot to the position indicated in dotted lines in FIG. 4 and water pressure exerted against the inner surface 26 of the wing member 18 will again force the tool 66, such as a vacuum-type device, against the floor of the tank.

During the upward movements of the pole 12 and brush 14 in FIG. 3 or the backward movement of the pole 12 and tool 66 in FIG. 4, fluid is gathered by the extending rim portion 30 and reinforcing ridges 36 of the wing member 18 and is directed toward and through the apertures 32. The fluid is jetted through the nozzles 34 and dispelled at high pressure against either the wall or floor of the tank, thereby aiding the tool 66 in dislodging deposits from the tank's interior surfaces and forcing such removed material away from the inner wall or floor to prevent reattachment.

Means for providing cleaning fluid to the area adjacent the tool 66 may also be provided. Herein, the term cleaning fluid is defined as any fluid, such as liquid or powdered chlorine or other chemical, capable of passing through the device 10. As seen in FIG. 5, the pole 12 is preferably hollow or otherwise has a conduit 72 running its length. The uppermost end 68, or "grip end", of the pole 12 has means for delivering a cleaning fluid to the conduit 72. For instance, the uppermost end 68 of the pole 12 may be threaded and capable of receiving a correspondingly threaded container 70 holding the cleaning fluid. Means for expelling the cleaning fluid are provided adjacent the brush 14. For instance, a cleaning fluid expelling opening may be provided adjacent the brush 14 and receivable to the conduit 72. In this way, the container 70 will deliver cleaning fluid to the conduit 72, and the fluid will be expelled from the conduit 72 through the cleaning fluid expelling opening to the area adjacent the brush 14 and the wall or floor. This will enable the concentration of the cleaning fluid where it is most needed, i.e., along the walls and floor of the tank. For example, in a swimming pool, during the upward movement of the pole 12, water will be forced through the jetting means of the wing member 18 towards the wall and will concentrate the delivery of chlorine toward the brush bristles 64 and wall. Likewise, the jetted water will force deposits, such as algae, away from the wall so that they do not reattach themselves. The same effect is obtained when the device 10 is used to clean a tank floor when the pole 12 and vacuum are moved backwards, as seen in FIG. 4. It should be noted that while it is preferred that the embodiment of the device 10 incorporating means for delivering cleaning fluid to the tool area employ a wing member 18 which pivots both upwards and downward, it may also be used in conjunction in devices having member-like elements which pivot in only one direction.

Therefore, not only does the present invention hold the brush 14 or other tool 66 against the inner surface 26 of the tank during movement of the pole 12 both towards and away from the operator, but the jetting means provide enhanced efficiency to the cleaning operation. Also, the cleaning operation can be further enhanced when the embodiment including the means for delivering and expelling a cleaning fluid are provided in the device 10 along with the wing member 18.

The above disclosed invention has a number of particular features which should preferably be employed in combination, although each is useful separately without departure from the scope of the invention. While preferred embodiments are shown and described, it should be understood that the invention may be embodied otherwise as herein specifically illustrated or described, and that certain changes in the form and arrangements of the parts and its specific manner of practicing the invention may be made within the underlying idea or principals of the invention within the scope of the appended claims.

What is claimed is:

1. A device for cleaning a surface submerged in a fluid at a distance from an operator, comprising:
   (a) a pole;
   (b) a tool attachable to said pole at a distance from said operator;
   (c) a wing member having an attachment side pivotally attachable to said pole and a distal side opposite said attachment side, said wing member pivotable in relation to said pole for forcing said tool against said surface by hydrodynamic forces when said tool is moved towards and away from said operator;
   (d) jetting means provided on said wing member for directing said fluid towards said surface when said tool is moved towards said operator; and
   (e) means for pivotally attaching said wing member to said pole.

2. The device of claim 1, wherein said jetting means comprise a jet nozzle surrounding an aperture in said wing member.

3. The device of claim 1, wherein said wing member has an inner surface facing said tool and an outer surface opposite said inner surface, and further wherein said aperture extends from said outer surface to said inner surface and said jet nozzle 4. The device of claim 3, and further comprising means for directing fluid to said jetting means when said tool is moved towards said operator, said directing means comprising a rim portion extending from the outer surface of said wing member between the distal side of said wing member and said aperture.

5. The device of claim 4, and further comprising reinforcing ridges located along said outer surface of said wing member extending from said attachment side to said distal side.

6. The device of claim 5, wherein said reinforcing ridges are provided on each side of said aperture and connected to said rim portion to further direct said fluid to said aperture.

7. The device of claim 1, wherein said distal side is wider than said attachment side so that said wing member is fan-shaped.

8. The device of claim 1, wherein said jetting means are located adjacent said distal side of said wing member.

9. The device of claim 1, and further comprising means for directing fluid to said jetting means when said tool is moved towards said operator.

10. The device of claim 9, wherein said directing means comprise a rim portion extending from said wing member adjacent said jetting means.

11. The device of claim 10, wherein said rim portion is highest at said distal side of said wing member and narrows towards said attachment side of said wing member.

12. The device of claim 1, wherein said means for pivotally attaching said wing member to said pole comprise a yoke and post type attaching means.

13. The device of claim 1, wherein said wing member has a pair of support flanges extending from its attachment side, each said support flange having a support aperture through which a post may be simultaneously provided; and further comprising a clamping assembly securable to said pole, said clamping assembly having a wing member attachment hole through which said post may be provided while simultaneously in said support apertures, thereby connecting said wing member to said clamping member.

14. The device of claim 13, wherein said clamping assembly has a first stopping flange extending from the upper portion of said clamping assembly and a second stopping flange extending from said clamping assembly below said first stopping flange, said first clamping assembly having an upper wing member attachment hole located between said stopping flanges so that said stopping flanges limit the pivot of said wing member.

15. The device of claim 14, wherein said first stopping flange has a wing member contacting surface having an angle approximately 45° relative to the transverse axis of said pole for limiting the upward pivot of said wing member to approximately 45° relative to said transverse axis of said pole when said tool is moved away from said operator.

16. The device of claim 14, wherein said second stopping flange has a wing member contacting surface having an angle approximately 45° relative to the transverse axis of said pole for limiting the downward pivot of said wing member to approximately 45° relative to said transverse axis of said pole when said tool is moved towards said operator.

17. The device of claim 14, wherein said clamping assembly has a lower wing member attachment hole located between said upper wing member attachment hole and said second stopping flange for limiting the downward pivot of said wing member to a position approximately perpendicular to the pole when said tool is moved towards said operator.

18. The device of claim 1, wherein said pole has a grip end and a tool end opposite said grip end; and further comprising:

(a) a conduit running longitudinally along the length of said pole from said grip end to said tool end;
(b) means for delivering a cleaning fluid to said conduit located adjacent said grip end; and
(c) means for expelling said cleaning fluid from said conduit located adjacent said tool end.

19. The device of claim 18, wherein said grip end of said handle is threaded to receive a correspondingly threaded container capable of delivering said cleaning fluid to said conduit.

20. The device of claim 18, wherein said handle has an aperture adjacent said brush from which said cleaning fluid can be expelled.

21. The device of claim 1, wherein said tool is a brush.

22. The device of claim 1, wherein said tool is a vacuuming device.

23. The device of claim 1, and further comprising means for limiting the pivot of said wing member to an upwards position approximately 45° relative to the transverse axis of said pole.

24. The device of claim 1, and further comprising means for limiting the pivot of said wing member to a downward position approximately 45° relative to the transverse axis of said pole.

25. The device of claim 1, and further comprising means for limiting the pivot of said wing member to a downward position perpendicular to of said pole.

26. A device for maintaining a tool provided on a pole against a surface submerged in a fluid, comprising:

(a) a wing member having an attachment side pivotally attachable to said pole and a distal side opposite said attachment side, said wing member pivotable in relation to said pole for forcing said tool against said surface by hydrodynamic forces when said tool is moved towards and away from said operator;
(b) jetting means provided on said wing member for jetting said fluid towards said surface when said tool is moved towards said operator; and
(c) means for pivotally attaching said wing member to said pole.

27. The device of claim 26, wherein said jetting means comprise a jet nozzle surrounding an aperture in said wing member.

28. The device of claim 26, wherein said wing member has an inner surface facing said tool and an outer surface opposite said inner surface, and further wherein said aperture extends from said outer surface to said inner surface and said jet nozzle extends from said inner surface.

29. The device of claim 28, and further comprising means for directing fluid to said jetting means when said tool is moved towards said operator, said directing means comprising a rim portion extending from the outer surface of said wing member between the distal side of said wing member and said aperture.

30. The device of claim 29, and further comprising reinforcing ridges located along said outer surface of said wing member extending from said attachment side to said distal side.

31. The device of claim 30, wherein said reinforcing ridges are provided on each side of said aperture and connected to said rim portion to further direct said fluid to said aperture.

32. The device of claim 26, wherein said distal side is wider than said attachment side so that said wing member is fan-shaped.

33. The device of claim 26, wherein said jetting means are located adjacent said distal side of said wing member.

34. The device of claim 26, and further comprising means for directing fluid to said jetting means when said tool is moved towards said operator.

35. The device of claim 34, wherein said directing means comprise a rim portion extending from said wing member adjacent said jetting means.

36. The device of claim 34, wherein said rim portion is highest at said distal side of said wing member and narrows towards said attachment side of said wing member.

37. The device of claim 26, wherein said means for pivotally attaching said wing member to said pole comprise a yoke and post type attaching means.

38. The device of claim 26, wherein said wing member has a pair of support flanges extending from its attachment side, each said support flange having a support aperture through which a post may be simultaneously provided; and further comprising a clamping assembly securable to said pole, said clamping assembly having a wing member attachment hole through which said post may be provided while simultaneously in said support apertures, thereby connecting said wing member to said clamping member.

39. The device of claim 38, wherein said clamping assembly has a first stopping flange extending from the upper portion of said clamping assembly and a second stopping flange extending from said clamping assembly below said first stopping flange, said first clamping assembly having an upper wing member attachment hole located between said stopping flanges so that said stopping flanges limit the pivot of said wing member.

40. The device of claim 39, wherein said first stopping flange has a wing member contacting surface having an angle approximately 45° relative to the transverse axis of said pole for limiting the upward pivot of said wing member to approximately 45° relative to said transverse axis of said pole when said tool is moved away from said operator.

41. The device of claim 39, wherein said second stopping flange has a wing member contacting surface having an angle approximately 45° relative to the transverse axis of said pole for limiting the downward pivot of said wing member to approximately 45° relative to said transverse axis of said pole when said tool is moved towards said operator.

42. The device of claim 39, wherein said clamping assembly has a lower wing member attachment hole located between said upper wing member attachment hole and said second stopping flange for limiting the downward pivot of said wing member to a position relative perpendicular to the pole when said tool is moved towards said operator.

43. The device of claim 26, wherein said tool is a brush.

44. The device of claim 26, wherein said tool is a vacuuming device.

45. The device of claim 26, and further comprising means for limiting the pivot of said wing member to an upwards position approximately 45° relative to the transverse axis of said pole.

46. The device of claim 26, and further comprising means for limiting the pivot of said wing member to a downward position approximately 45° relative to the transverse axis of said pole.

47. The device of claim 26, and further comprising means for limiting the pivot of said wing member to a downward position perpendicular to of said pole.

48. A device for cleaning a surface submerged in a fluid at a distance from an operator, comprising:

(a) a pole having a grip end and a tool end;

(b) a tool attachable to said pole at a distance from said operator;

(c) a wing member having an attachment side pivotally attachable to said pole and a distal side opposite said attachment side, said wing member pivotable in relation to said pole for forcing said tool against said surface by hydrodynamic forces when said tool is moved towards and away from said operator;

(d) means for pivotally attaching said wing member to said pole;

(e) a conduit running longitudinally along the length of said pole from said grip end to said tool end;

(f) means for delivering a cleaning fluid to said conduit located adjacent said grip end; and (g) means for expelling said cleaning fluid from said conduit located adjacent said tool end.

49. The device of claim 48, wherein said grip end of said handle is threaded to receive a correspondingly threaded container capable of delivering said cleaning fluid to said conduit.

50. The device of claim 48, wherein said handle has an aperture adjacent said brush from which said cleaning fluid can be expelled.

* * * * *